US011315492B2

(12) United States Patent
Choi et al.

(10) Patent No.: US 11,315,492 B2
(45) Date of Patent: Apr. 26, 2022

(54) DISPLAY DEVICE AND METHOD FOR DRIVING THE SAME

(71) Applicant: LG DISPLAY CO., LTD., Seoul (KR)

(72) Inventors: SoekMin Choi, Gangneung-si (KR); NakJin Seong, Gyeonggi-do (KR); MooKyoung Hong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/060,729

(22) Filed: Oct. 1, 2020

(65) Prior Publication Data

US 2021/0104195 A1 Apr. 8, 2021

(30) Foreign Application Priority Data

Oct. 2, 2019 (KR) ..... 10-2019-0122498

(51) Int. Cl.
*G09G 3/3258* (2016.01)

(52) U.S. Cl.
CPC ... *G09G 3/3258* (2013.01); *G09G 2300/0842* (2013.01); *G09G 2310/0291* (2013.01); *G09G 2310/08* (2013.01)

(58) Field of Classification Search
None
See application file for complete search history.

(56) References Cited

U.S. PATENT DOCUMENTS

2016/0189623 A1* 6/2016 Miwa ..... G09G 3/3258 345/212

FOREIGN PATENT DOCUMENTS

| | | | |
|---|---|---|---|
| EP | 2983165 | A1 | 2/2016 |
| KR | 10-2016-0047676 | A | 5/2016 |
| KR | 10-2017-0051782 | A | 5/2017 |
| KR | 10-2017-0081051 | A | 7/2017 |
| KR | 10-2019-0059674 | A | 5/2019 |
| KR | 20190059674 | * | 5/2019 |

OTHER PUBLICATIONS

Extended European Search Report issued in corresponding European Patent Application No. 20198144.6, dated Dec. 16, 2020.

* cited by examiner

*Primary Examiner* — Nitin Patel
*Assistant Examiner* — Amen W Bogale
(74) *Attorney, Agent, or Firm* — Morgan, Lewis & Bockius LLP

(57) ABSTRACT

The present disclosure relates to display devices and methods of driving the display devices. In accordance with embodiments of the present disclosure, it is possible to improve image quality of a display device by reducing a sensing time for sensing one or more characteristic values of at least one driving transistor disposed in at least one sub-pixel. Further, it is possible to perform optimal sensing and compensation for at least one driving transistor by setting a minimum sensing time for one or more characteristic values of the at least one driving transistor and changing the sensing time according to a sensing available time of the display device.

7 Claims, 11 Drawing Sheets

DISPLAY DEVICE AND METHOD FOR DRIVING THE SAME

CROSS-REFERENCE TO RELATED APPLICATION

This application claims the priority benefit of Korean Patent Application No. 10-2019-0122498, filed on Oct. 2, 2019 in the Korean Intellectual Property Office, the disclosure of which is incorporated herein by reference in its entirety.

TECHNICAL FIELD

The present disclosure relates to display devices and methods of driving the display devices.

DESCRIPTION OF THE RELATED ART

As the information-oriented society has been developed, various needs for display devices for displaying an image have increased. Recently, various types of display devices, such as a liquid crystal display (LCD) device, an organic light emitting display device, and the like have been utilized.

Among these display devices, the organic light emitting display device has high response speed and has advantages in contrast ratio, luminous efficiency, luminance, viewing angle, and the like, by using an organic light emitting diode, which is a self-emissive element.

The organic light emitting display device includes an organic light emitting diode disposed in each of a plurality of sub-pixels arranged in a display panel. Such an organic light emitting display device can control luminance resulted from each sub-pixel and display images by allowing the organic light emitting diode to emit light through the control of a current flowing through, or a voltage applied to, the organic light emitting diode.

In the case of the organic light emitting display device, an organic light emitting diode and a driving transistor for driving the organic light emitting diode are disposed in each sub-pixel of the display panel. In this case, characteristic values, such as threshold voltage, mobility, and the like, of each driving transistor may be changed by the aging of the driving transistor, or a deviation in characteristic values between transistors may occur due to a difference in driving times between sub-pixels. Because of this, a deviation (non-uniformity) in luminance between sub-pixels may occur, and in turn, image quality may be degraded.

In order to solve a deviation in luminance between sub-pixels, in the case of the organic light emitting display device, a technology has been proposed for sensing one or more characteristic values, such as threshold voltage, mobility, and the like, of a driving transistor and then, compensating for a change in one or more characteristic values. However, in spite of the proposed sensing and compensation technology, a sensing error sometimes occurs for an unexpected reason and an abnormality occurs in display images.

In particular, one or more characteristic values of a driving transistor can be sensed in real time while image driving is performed, which is sometimes referred to as a real-time (RT) sensing process. In the case of the real-time sensing process, the sensing process may be performed for one or more sub-pixels of one or more sub-pixel arrays for each blank period during an image driving period.

Further, a period for sensing the characteristic values of the driving transistor may be assigned after a power-on signal is applied to the organic light emitting display device and before image driving is initiated. This sensing process is sometimes referred to as an on-sensing process. In some instances, a period for sensing the characteristic values of the driving transistor may be assigned after a power-off signal is applied to the organic light emitting display device. This sensing process is sometimes referred to as an off-sensing process.

Here, since a time at which one or more characteristic values of the driving transistor are sensed is required to have at least a predetermined value for the accuracy of sensing values, a process of sensing the characteristic values of the driving transistor can performed at a time at which a preset sensing time elapses.

However, as resolutions of display devices are increased, there occurs a problem that a sensing time and a compensation time for a sub-pixel SP are increased. For example, sensing and compensation times may take 1 minute or more for a full high definition (FHD) display device, 5 minutes or more for an ultra high definition (UHD) display device, and 20 minutes or more for a quantum dot ultra high definition (QuHD) display device.

In particular, in the off-sensing process, when power supplying to these display devices is terminated, there sometimes occurs a case in which a compensation of at least one characteristic value of one or more driving transistors is not performed.

SUMMARY

Accordingly, embodiments of the present disclosure are directed to a display device and a method for driving the same that substantially obviate one or more of the problems due to limitations and disadvantages of the related art.

It is an object of the present disclosure to provide a display device and a driving method for enabling a sensing time needed to sense one or more characteristic values of a driving transistor disposed in a sub-pixel to be reduced.

It is another object of the present disclosure to provide a display device and a driving method for enabling optimal sensing and compensation to be implemented by setting a minimum sensing time for one or more characteristic values of a driving transistor and then changing the sensing time according to a sensing available time of the display device.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

In accordance with one aspect of the present disclosure, a display device is provided that includes a display panel on which a plurality of gate lines, a plurality of data lines, and a plurality of sub-pixels are arranged, a gate driving circuit for driving the plurality of gate lines, a data driving circuit for driving the plurality of data lines, and a timing controller controlling the gate driving circuit and the data driving circuit, and causing a threshold voltage of at least one driving transistor of at least one of the plurality of sub-pixels to be sensed at a minimum sensing time representing a critical threshold voltage difference corresponding to a reference threshold voltage difference.

The reference threshold voltage difference may correspond to a difference between a maximum threshold voltage and a minimum threshold voltage of the driving transistors.

The critical threshold voltage difference may have a value identical or similar to the reference threshold voltage difference.

The subpixel may include a light emitting element such as an organic light emitting diode, a driving transistor for driving the light emitting element, a switching transistor electrically connected between a gate node of the driving transistor and a data line, a sensing transistor electrically connected between a source node or a drain node of the driving transistor and a reference voltage line, and a storage capacitor electrically connected between the gate node and the source node or the drain node of the driving transistor.

The sensing of a threshold voltage for the driving transistor may include an initialization step of providing a data voltage for sensing through the data line and providing a reference voltage for sensing through the reference voltage line, a tracking step in which a voltage in the reference voltage line is allowed to rise by blocking the reference voltage for sensing, and a sampling step of sensing the threshold voltage of the driving transistor through the reference voltage line.

The display device according to embodiments of the present disclosure may further include a compensation circuit calculating a compensation value for an image data voltage and applying a changed image data voltage to a corresponding sub-pixel according to the calculated compensation value, using a sensing value for the threshold voltage of the driving transistor.

The compensation circuit may include an analog to digital converter measuring a voltage in the reference voltage line electrically connected to the driving transistor and converting the measured voltage into a digital value, a switch circuit connected between the driving transistor and the analog to digital converter and controlling operations for the sensing of a threshold voltage of the driving transistor, a memory storing a sensing value output from the analog to digital converter or storing a reference threshold voltage in advance, a compensator comparing between the sensing value and the reference threshold voltage stored in the memory and calculating a compensation value for compensating for a difference in the threshold voltage of the driving transistor, a digital to analog converter changing an image data voltage changed by the compensation value calculated from the compensator to an analog voltage, and a buffer outputting the image data voltage in the form of analog output from the digital to analog converter to an indicated data line among a plurality of data lines.

The timing controller may cause additional sensing and compensation of the threshold voltage of the driving transistor to be performed by sequentially increasing a sensing time from the minimum sensing time after the compensation is performed at the minimum sensing time by the compensation circuit.

In accordance with another aspect of the present disclosure, a method is provided of driving a display device including a display panel, on which a plurality of gate lines, a plurality of data lines, and a plurality of reference voltage lines are arranged, which includes a plurality of sub-pixels arranged in areas in which the plurality of data lines intersect the plurality of gate lines and causing organic light emitting diodes to emit light through driving transistors, the method comprising: sensing threshold voltages of one or more elements included in the display panel, deriving reference driving transistors having a maximum threshold voltage and a minimum threshold voltage, calculating a reference threshold voltage difference between the maximum threshold voltage and the minimum threshold voltage at a reference sensing time, calculating a threshold voltage difference between the maximum threshold voltage and the minimum threshold voltage of the reference driving transistors in a sensing time smaller than the reference sensing time, comparing between the threshold voltage difference and a critical threshold voltage difference, determining an immediately preceding sensing time as a minimum sensing time when the threshold voltage difference is smaller than the critical threshold voltage difference, and performing sensing and compensation of a threshold voltage for any driving transistor at the minimum sensing time.

The method of driving the display device according to embodiments of the present disclosure may perform additional sensing and compensation of the threshold voltage of the driving transistor by sequentially increasing a sensing time from the minimum sensing time after the compensation is performed at the minimum sensing time.

In accordance with further another aspect of the present disclosure, a display device is provided that includes a display panel on which a plurality of gate lines, a plurality of data lines, and a plurality of sub-pixel are arranged, a gate driving circuit for driving the plurality of gate lines, a data driving circuit for driving the plurality of data lines, and a timing controller controlling the gate driving circuit and the data driving circuit, and after sensing and compensation of a threshold voltage of a driving transistor of at least one sub-pixel of the plurality of sub-pixels at a minimum sensing time is performed, causing additional sensing and compensation of the threshold voltage of the driving transistor to be performed by sequentially increasing a sensing time from the minimum sensing time.

The sensing time may have a larger value as time passes.

In accordance with yet another aspect of the present disclosure, a method is provided of driving a display device including a display panel, on which a plurality of gate lines, a plurality of data lines, and a plurality of reference voltage lines are arranged, which includes a plurality of sub-pixels arranged in areas in which the plurality of data lines intersect the plurality of gate lines and causing organic light emitting diodes to emit light through driving transistors, the method comprising: sensing a minimum threshold voltage of at least one of driving transistors at a minimum sensing time, comparing the minimum threshold voltage of the at least one driving transistor and a reference threshold voltage, compensating for the minimum threshold voltage of the at least one driving transistor, performing sequentially sensing and compensation of the threshold voltage of the at least one driving transistor by increasing a sensing time, determining whether a sensing process for the threshold voltage of the at least one driving transistor is terminated, and terminating the compensation process when the sensing process is terminated.

In accordance with embodiments of the present disclosure, it is possible to improve image quality of a display device by reducing a sensing time for sensing characteristic values of a driving transistor disposed in a sub-pixel.

In accordance with embodiments of the present disclosure, it is possible to perform optimal sensing and compensation for a driving transistor by setting a minimum sensing time for one or more characteristic values of a driving transistor and then by changing the sensing time according to a sensing available time of the display device.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

DETAILED DESCRIPTION

Figure 1:
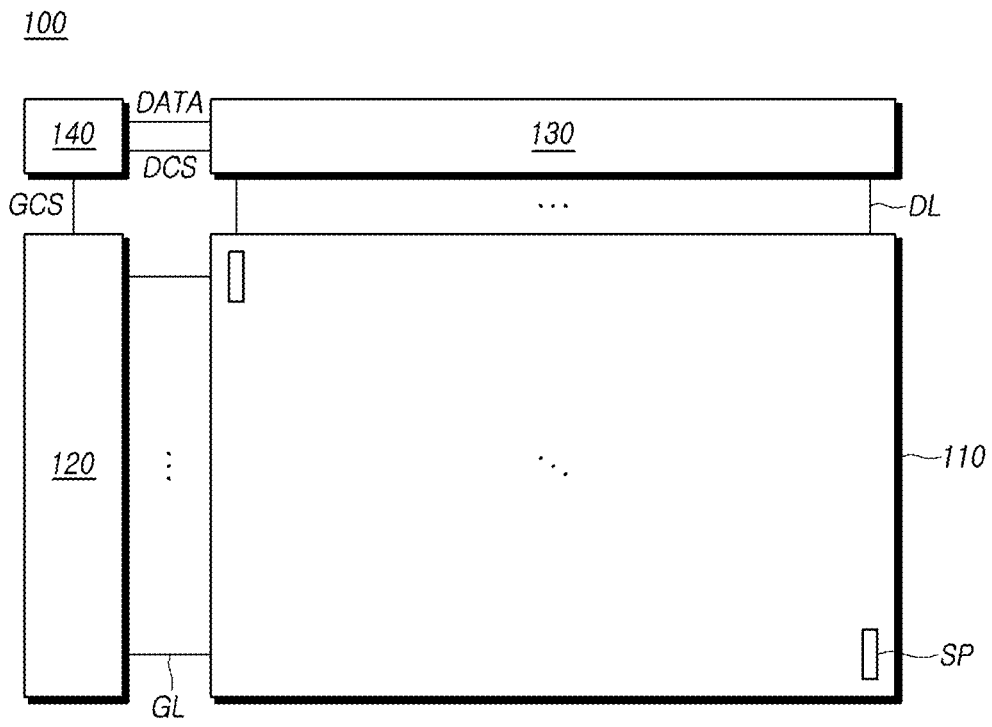
FIG. 1 schematically illustrates a configuration of an organic light emitting display device according to embodiments of the present disclosure.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person having ordinary skill in the art. The scope of the present disclosure shall be defined by the appended Claims.

The shapes, sizes, ratios, angles, numbers, and the like, inscribed in the drawings to illustrate exemplary embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby. It will be understood that the terms "comprise," "include," "have," and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of components according to exemplary embodiments, it shall be understood that an error range is included therein, even in the case in which there is no explicit description thereof.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element. In the same context, it will be understood that when an element is referred to as being formed "on" or "under" another element, not only can it be directly located on or under the other element, but it can also be indirectly located on or under the other element via an intervening element.

In addition, terms, such as "first" and "second" may be used herein to describe a variety of components. It should be understood, however, that these components are not limited by these terms. These terms are merely used to discriminate one element or component from other elements or components. Thus, a first element referred to as first hereinafter may be a second element within the spirit of the present disclosure.

The features of exemplary embodiments of the present disclosure may be partially or entirely coupled or combined with each other and may work in concert with each other or may operate in a variety of technical methods. In addition, respective exemplary embodiments may be carried out independently or may be associated with and carried out in concert with other embodiments.

Hereinafter, exemplary embodiments will be described in detail with reference to the drawings.

FIG. 1 schematically illustrates a configuration of an organic light emitting display device according to embodiments of the present disclosure.

Referring to FIG. 1, the organic light emitting display device 100 according to embodiments of the present disclosure may include a display panel 110 on which a plurality of subpixels SP is arranged in a matrix form, a gate driving circuit 120 and a data driving circuit 130 for driving the display panel 110, and a timing controller 140 for controlling the gate driving circuit 120 and the data driving circuit 130.

A plurality of gate lines GL and a plurality of data lines DL are arranged on the display panel 110, and the plurality of sub-pixels SP is arranged in areas in which the gate lines GL and the data lines DL intersect each other For example, in the case of an organic light emitting display device 100 with the resolution of 2,160×3,840, 2,160 gate lines GL and 3,840 data lines DL can be arranged, and sub-pixels SP can be arranged in respective areas in which the gate lines GL and the data lines DL intersect each other.

The gate driving circuit 120 is controlled by the timing controller 140, and controls driving timings for the plurality of subpixels by sequentially outputting scan signals SCAN to the plurality of gate lines GL arranged in the display panel 110. In the organic light emitting display device 100 with the resolution of 2,160×3,840, a scenario of sequentially outputting scan signals SCAN to 2,160 gate lines GL, that is, first to 2,160th gate lines GL1 to GL2,160, may be referred to as a 2,160-phase driving.

In another example, as in a scenario of sequentially outputting scan signals SCAN to fifth to eighth gate lines GL5 to GL8, after sequentially outputting scan signals SCAN to first to fourth gate lines GL1 to GL4, a scenario of sequentially outputting scan signals SCAN based on 4 gate lines GL may be referred to as a 4-phase driving. That is, a scenario of sequentially outputting scan signals SCAN based on N gate lines GL may be referred to as a N-phase driving.

The gate driving circuit 120 may include one or more gate driving integrated circuits GDIC. The gate driving circuit 120 may be located on one side or both sides of the display panel 110, such as, a left or right side, a top or bottom side, the left and right sides, or the top and bottom sides, according to a driving scheme. Further, the gate driving circuit 120 may be implemented in a Gate In Panel (GIP) type in which the gate driving circuit 120 is integrated in at least one bezel area of the display panel 110.

The data driving circuit 130 receives image data DATA from the timing controller 140, and converts the received image data DATA into data voltage for driving image Vdata in the form of analog. Thereafter, by outputting data voltage for driving image Vdata to respective data lines DL according to one or more timings at which one or more scan signals SCAN are applied to one or more gate lines GL, respective sub-pixels SP connected to the data lines DL can provide light-emitting signals with corresponding luminance according to the data voltage for driving image Vdata.

Likewise, the data driving circuit 130 may include one or more source driving integrated circuits SDIC. The source driving integrated circuit SDIC may be connected to a bonding pad of the display panel 110 in a Tape Automated Bonding TAB type or a Chip On Glass (COG) type, or directly disposed on the display panel 110.

In some instances, one or more source driving integrated circuits SDIC may be integrated and disposed on the display panel 110. Each source driving integrated circuit SDIC may be implemented in a Chip On Film (COF) type. In this case, the source driving integrated circuit SDIC may be mounted on a circuit film, and be electrically connected to one or more data lines of the display panel 110 through the circuit film.

The timing controller 140 can provide several control signals to the gate driving circuit 120 and the data driving circuit 130 and control operations of the gate driving circuit 120 and the data driving circuit 130. That is, the timing controller 140 can control the gate driving circuit 120 to output a scan signal SCAN according to a timing processed in each frame, convert image data received from the outside, such as external devices or image providing sources, to a data signal form used in the data driving circuit 130, and then output the converted image data to the data driving circuit 130.

Here, the timing controller 140 can receive, together with the image data, several types of timing signals including a vertical synchronous signal VSYNC, a horizontal synchronous signal HSYNC, a data enable signal DE, a clock signal CLK, and the like from the outside (e.g., a host system). The timing controller 140 can generate control signals using the timing signals received from the outside such as the host system, and provide the generated signals to the gate driving circuit 120 and the data driving circuit 130.

For example, in order to control the gate driving circuit 120, the timing controller 140 can output several types of gate control signals GCS including a gate start pulse GSP, a gate shift clock GSC, a gate output enable signal GOE, and the like. Here, the gate start pulse GSP is used for controlling a start point for operating one or more gate driving integrated circuits GDIC included in the gate driving circuit 120. The gate shift clock GSC is a clock signal commonly inputted to one or more gate driving integrated circuits GDIC, and is used for controlling a shift timing of a scan signal SCAN. The gate output enable signal GOE is used for indicating timing information of one or more gate driving integrated circuits GDIC.

For example, in order to control the data driving circuit 130, the timing controller 140 can output several types of data control signals DCS including a source start pulse SSP, a source sampling clock SSC, a source output enable signal SOE, and the like. Here, the source start pulse SSP is used for controlling a data sampling start timing of one or more source driving integrated circuits SDIC included in the data driving circuit 130. The source sampling clock SSC is a clock signal for controlling a sampling timing of data in the source driving integrated circuit SDIC. The source output enable signal SOE is used for controlling an output timing of the data driving circuit 130.

The organic light emitting display device 100 may further include a power management integrated circuit for providing several types of voltages or currents to the display panel 110, the gate driving circuit 120, the data driving circuit 130, and the like, or for controlling the several types of voltages or currents to be provided.

Meanwhile, a sub-pixel SP may be located at a location at which the gate line GL and the data line DL intersect each other, and a light emitting element such as an organic light emitting diode may be disposed in each subpixel SP. For example, the organic light emitting display device 100 can include a light emitting element such as a light emitting diode (LED) or an organic light emitting diode (OLED) in each sub-pixel SP, and display images by controlling a current flowing through the light emitting element according to a data voltage for driving image Vdata.

Figure 2:
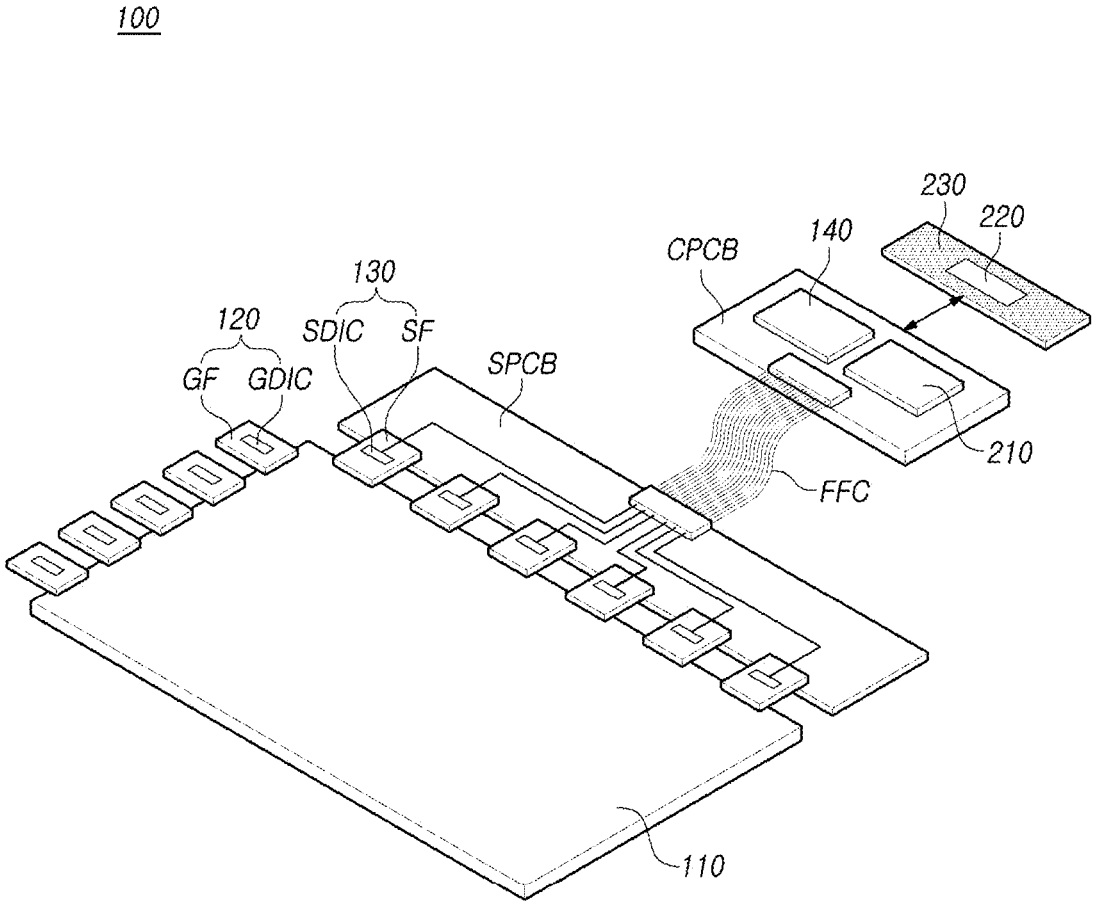
FIG. 2 illustrates a system of the organic light emitting display device according to embodiments of the present disclosure.

FIG. 2 illustrates a system of the organic light emitting display device according to embodiments of the present disclosure.

FIG. 2 illustrates that in the organic light emitting display device 100 according to embodiments of the present disclosure, one or more source driving integrated circuits SDIC included in the data driving circuit 130 are implemented in the COF type among various types (the TAB, the COG, the COF etc.), and the gate driving circuit 120 is implemented in the GIP type among various types (the TAB, the COG, the COF, the GIP etc.).

The source driving integrated circuits SDIC included in the data driving circuit 130 may be mounted on respective source-side circuit films SF, and one side of each source-side circuit film SF may be electrically connected to the display panel 110. Lines for electrically connecting between the source driving integrated circuits SDIC and the display panel 110 may be arranged on the source-side circuit film SF.

For circuital connections between the source driving integrated circuits SDIC and other units or devices, the organic light emitting display device 100 may include at least one source printed circuit board SPCB, and a control printed circuit board CPCB for mounting control components and several types of electrical units or devices.

Here, the other side of each source-side circuit film SF on which the source driving integrated circuit SDIC is mounted may be connected to the at least one source printed circuit board SPCB. That is, one side of the source-side circuit film SF on which the source driving integrated circuit SDIC is mounted may be electrically connected to the display panel 110 and the other side thereof may be electrically connected to the source printed circuit board SPCB.

The timing controller 140 and the power management integrated circuit 210 may be mounted on the control printed circuit board CPCB. The timing controller 140 can control operations of the data driving circuit 130 and the gate driving circuit 120. The power management integrated circuit 210 can provide several types of voltages or currents including a driving voltage to the display panel 110, the data driving circuit 130, the gate driving circuit 120, and the like, or control voltages or currents to be provided.

The at least one source printed circuit board SPCB and the control printed circuit board CPCB may be electrically connected to each other through at least one connector, such as a flexible printed circuit FPC, a flexible flat cable FFC, or the like. Further, in one embodiment, the at least one source printed circuit board SPCB and the control printed circuit board CPCB may be integrated into one printed circuit board.

The organic light emitting display device 100 may further include a set board 230 electrically connected to the control printed circuit board CPCB. The set board 230 may be referred to as a power board. A main power management circuit M-PMC 220 managing the entire power of the organic light emitting display device 100 may be included in the set board 230. The main power management circuit 220 may be operated in connection with the power management integrated circuit 210.

In the case of the organic light emitting display device 100 including these configurations, a driving voltage EVDD is generated from the set board 230 and then provided to the power management integrated circuit 210 of the control printed circuit board CPCB. The power management integrated circuit 210 provides a driving voltage EVDD needed in an image driving period or a sensing period to the source printed circuit board SPCB through the flexible flat cable FFC or the flexible printed circuit FPC. The driving voltage EVDD provided to the source printed circuit board SPCB is provided for causing a specific sub-pixel SP in the display panel 110 to emit light or sensing the sub-pixel SP through the source driving integrated circuit SDIC.

Here, each sub-pixel SP arranged in the display panel 110 of the organic light emitting display device 100 may include an organic light emitting diode (OLED), as an example of a light emitting element, a driving transistor for driving the organic light emitting diode, and the like.

Types of circuit elements and the number of the circuit elements included in each subpixel SP may be different depending on types of the display panel, provided functions, design schemes/features, or the like.

Figure 3:
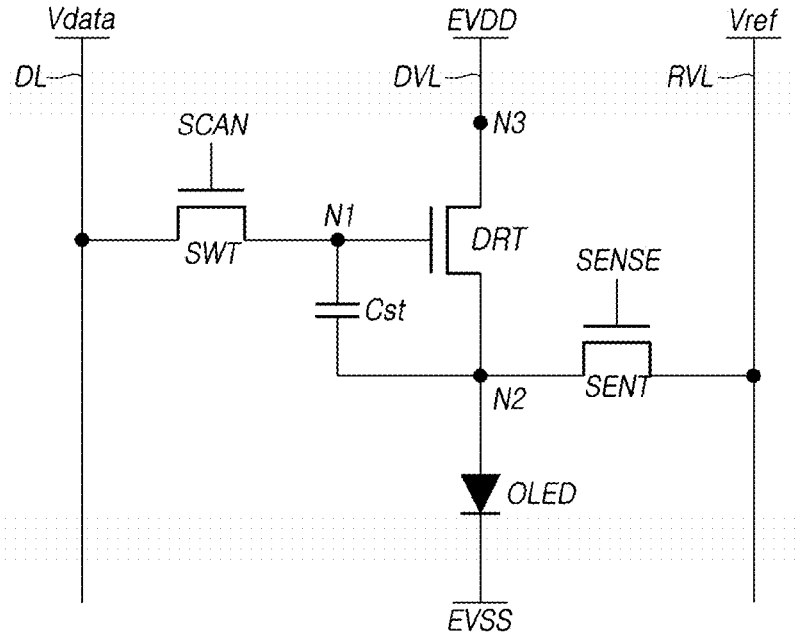
FIG. 3 illustrates a circuit configuration of a sub-pixel SP disposed in the organic light emitting display device according to embodiments of the present disclosure.

FIG. 3 illustrates a circuit configuration of a sub-pixel SP disposed in the organic light emitting display device according to embodiments of the present disclosure.

Referring to FIG. 3, a sub-pixel SP disposed in the organic light emitting display device 100 may include one or more transistors and a capacitor, and include an organic light emitting diode OLED as a light emitting element. For example, the sub-pixel SP may include a driving transistor DRT, a switching transistor SWT, a sensing transistor SENT, a storage capacitor Cst, and an organic light emitting diode OLED.

A turn-on or turn-off of the switching transistor SWT may be controlled by a scan signal SCAN applied to a gate node through a corresponding gate line GL, and a turn-on or turn-off of the sensing transistor SENT may be controlled by a sense signal SENSE different from the scan signal SCAN applied to a gate node through a corresponding gate line GL.

The driving transistor DRT has a first node N1, a second node N2, and a third node N3. The first node N1 of the driving transistor DRT may be a gate node to which a data voltage for driving image Vdata is applied through a data line DL when the switching transistor SWT is turned on. The second node N2 of the driving transistor DRT may be electrically connected to an anode electrode of the organic light emitting diode OLED, and may be a source node or a drain node of the driving transistor DRT. The third node N3 of the driving transistor DRT may be electrically connected to a driving voltage line DVL to which a driving voltage EVDD is applied, and be the drain node or the source node.

Here, in an image driving period, a driving voltage EVDD needed for image driving may be provided to the driving voltage line DVL. For example, the driving voltage EVDD needed for image driving may be 27V.

The switching transistor SWT is electrically connected between the first node N1 and the data line DL of the driving transistor DRT, and operates according to a scan signal SCAN provided through a gate line GL connected to the gate node. Further, when the switching transistor SWT is turned on, operations of the driving transistor DRT can be controlled by allowing a data voltage for driving image Vdata provided through the data line DL to be applied to the gate node of the driving transistor DRT.

The sensing transistor SENT is electrically connected between the second node N2 of the driving transistor DRT and a reference voltage line RVL, and operates according to the sense signal SENSE provided through the gate line connected to the gate node. When the sensing transistor SENT is turned on, a reference voltage for sensing Vref provided through the reference voltage line RVL is applied to the second node N2 of the driving transistor DRT. That is, voltages in the first and second nodes of the driving transistor DRT can be controlled by controlling the switching transistor SWT and the sensing transistor SENT; as a result, currents for driving the organic light emitting diode OLED can be provided.

The switching transistor SWT and the sensing transistor SENT may be connected to a same gate line or to different signal lines. FIG. 3 illustrates that the switching transistor SWT and the sensing transistor SENT are connected to different signal lines. In this situation, the switching transistor SWT can be controlled by a scan signal SCAN and the sensing transistor SENT can be controlled by a sense signal SENSE, which are provided through respective gate lines.

Meanwhile, the transistors disposed in the subpixel SP may be n-type transistors or p-type transistors; herein, the transistors in FIG. 3 represent the n-type transistors.

The storage capacitor Cst is electrically connected between the first node N1 and the second node N2 of the driving transistor DRT, and remains a data voltage for driving image Vdata during one frame.

According to a type of the driving transistor DRT, the storage capacitor Cst may be connected between the first node N1 and the third node N3 of the driving transistor DRT. An anode electrode of the organic light emitting diode OLED may be electrically connected to the second node N2 of the driving transistor DRT, and a low-level voltage EVSS may be applied to a cathode electrode of the organic light emitting diode OLED. Here, the low-level voltage EVSS may be a ground voltage or a voltage higher or lower than the ground voltage. The low-level voltage EVSS may vary depending on driving states. For example, the low-level voltage EVSS at the time of image driving may be set differently from the low-level voltage EVSS at the time of sensing driving.

It should be understood that the subpixel structure with three transistors and one capacitor (3T1C) shown in FIG. 3 is merely one example of possible subpixel structures for convenience of discussion, and embodiments of the present disclosure may be implemented in any of various structures, as desired. For example, the subpixel may further include at least one transistor and/or at least one capacitor. In some embodiments, a plurality of subpixels may have an identical structure, or at least one of the plurality of subpixels may have different structure from others.

Image driving for causing such a sub-pixel SP to emit light may be performed through an image data writing step, a boosting step, and a light emitting step.

In the image data writing step, an data voltage for driving image Vdata corresponding to an image signal may be applied to the first node N1 of the driving transistor DRT, and an reference voltage for driving image Vref may be applied to the second node N2 of the driving transistor DRT. Here, due to resistance properties etc. between the second node N2 of the driving transistor DRT and the reference voltage line RVL, a voltage similar to the reference voltage for driving image Vref may be applied to the second node N2 of the driving transistor DRT. The reference voltage for driving image Vref may be sometimes referred to as VpreR. In the image data writing step, electric charges corresponding to a potential difference (Vdata−Vref) between both terminals may be charged in the storage capacitor Cst.

The applying of an data voltage for driving image Vdata to the first node N1 of the driving transistor DRT may be referred to as the image data writing. In the boosting step after the image data writing step, the first and second nodes N1 and N2 may be electrically floated. To do this, the switching transistor SWT may be turned off by a scan signal SCAN with a turned-off level. Further, the sensing transistor SENT may be turned off by a sense signal SENSE with a turned-off level.

In the boosting step, as a potential difference between the first and second nodes N1 and N2 of the driving transistor DRT is remained, respective voltages in the first and second nodes N1 and N2 of the driving transistor DRT can be boosted. After voltages in the first and second nodes N1 and N2 of the driving transistor DRT through the boosting step are boosted, when a voltage in the second node N2 of the driving transistor DRT becomes equal to or greater than a certain value, for example, a voltage capable of turning on the organic light emitting diode OLED, the light emitting step is performed.

In the light emitting step, as a driving current flows across the organic light emitting diode OLED, the organic light emitting diode OLED can emit light.

At this time, driving transistors DRT disposed in a plurality of sub-pixel SP have unique characteristic values such as a threshold voltage, mobility, and the like. However, since the driving transistors DRT may be aged over driving times, the unique characteristic values of the driving transistors DRT may vary over time.

When the characteristic values (a threshold voltage, a mobility, etc.) of the driving transistors DRT vary, on and/or off timings of the driving transistors may vary or capabilities of driving the organic light emitting diodes OLED may vary. That is, as characteristic values of the driving transistors DRT vary, timings for providing currents to the organic light emitting diodes OLED and a quantity of current provided to the organic light emitting diodes OLED may vary. As a result, actual luminance of corresponding sub-pixels SP may vary according to characteristic values of the driving transistors DRT. Further, since a plurality of sub-pixels SP disposed in the display panel 110 have respective driving timings, a deviation in characteristic values (a deviation of threshold voltages, a deviation of mobility, etc.) between driving transistors DRT in respective sub-pixels SP may occur.

Such a deviation in characteristic values between the driving transistors DRT may cause a difference in luminance between sub-pixels SP, deteriorate the luminance uniformity of a corresponding display panel 110, and in turn, lead to a poor image quality.

Such an organic light emitting display device 100 may use a method of measuring a voltage charged in a storage capacitor Cst in a sensing period of a driving transistor DRT in order to sense effectively characteristic values of the driving transistor DRT, such as a threshold voltage or mobility. Further, the organic light emitting display device 100 may include a compensation circuit for compensating for a difference in one or more characteristic values of the driving transistor DRT, and provide a method of compensating using the compensation circuit.

That is, by measuring a voltage charged in the storage capacitor Cst in a sensing period of a driving transistor DRT, it is possible to obtain one or more characteristic values of the driving transistor DRT in a corresponding sub-pixel SP or a variance in the one or more characteristic values. At this time, since the reference voltage line RVL may serve to provide a reference voltage Vref and also serve as a sensing line for sensing characteristic values of the driving transistor DRT in the sub-pixel SP, the reference voltage line RVL may be sometimes referred to as the sensing line.

For example, in the organic light emitting display device 100, one or more characteristic values of a driving transistor DRT or a variance in the one or more characteristic values may correspond to a difference in respective voltages of first and second nodes N1 and N2 of the driving transistor DRT (e.g., Vdata−Vref).

Figure 4:
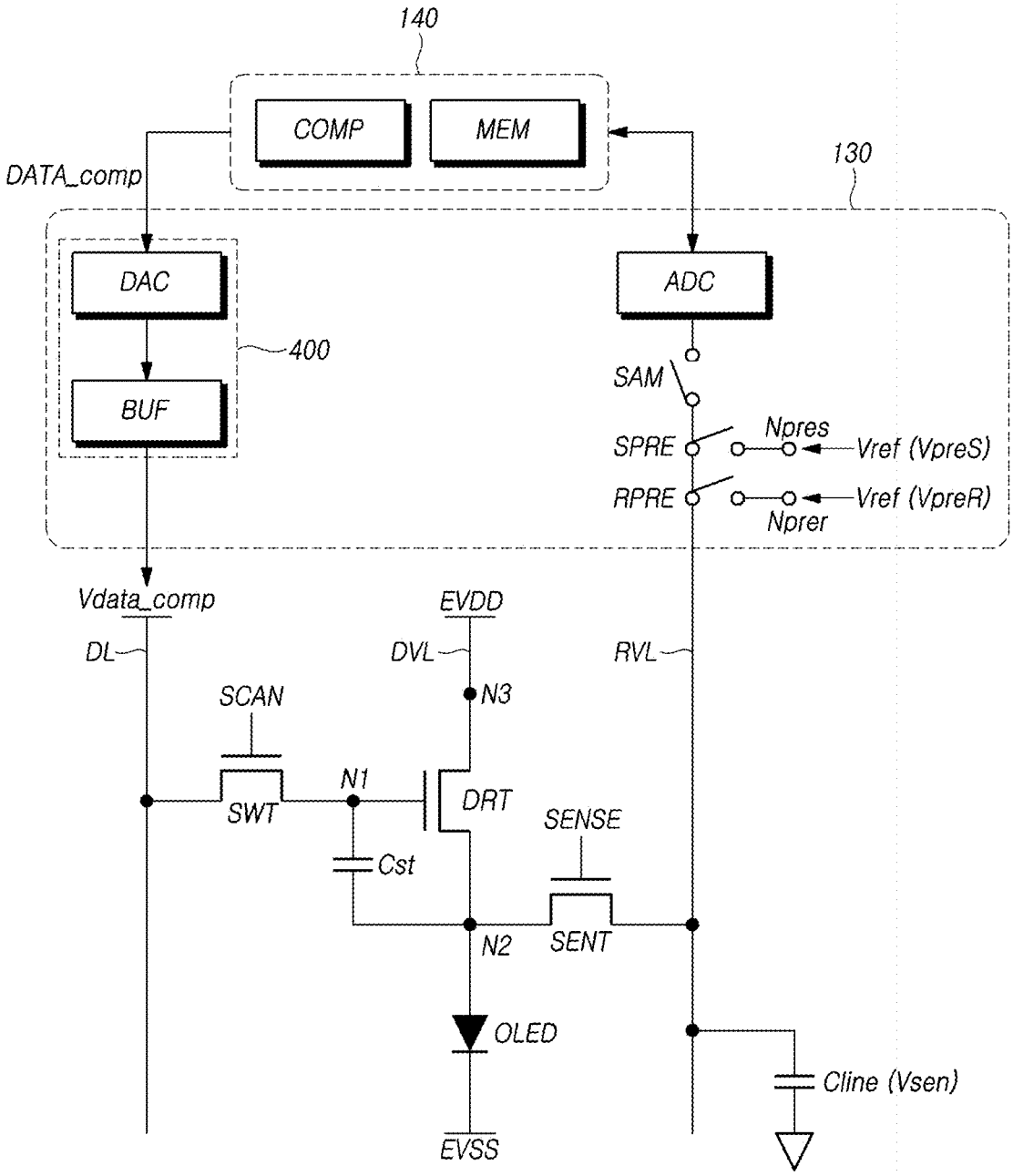
FIG. 4 illustrates a compensation circuit of the organic light emitting display device according to embodiments of the present disclosure.

FIG. 4 illustrates the compensation circuit of the organic light emitting display device according to embodiments of the present disclosure.

Referring to FIG. 4, to compensate for a difference in one or more characteristic values of a driving transistor DRT, the organic light emitting display device 100 according to embodiments of the present disclosure senses the one or more characteristic values of each driving transistor DRT or a difference in the one or more characteristic values. To do this, for a sub-pixel SP with the 3T1C structure or a structure modified from the 3T1C structure, the compensation circuit of the organic light emitting display device 100 according to embodiments of the present disclosure may include configurations or features for sensing one or more characteristic values or a difference in the one or more characteristic values of a driving transistor DRT of the sub-pixel SP in a sensing period.

Specifically, in a sensing period of the organic light emitting display device 100 according to embodiments of the present disclosure, one or more characteristic values or a difference in the one or more characteristic values of a driving transistor DRT may be reflected to a voltage in a second node N2 of the driving transistor DRT (e.g., Vdata–Vth). The voltage in the second node N2 of the driving transistor DRT may be corresponded to a voltage in a reference voltage line RVL when a sensing transistor SENT is tuned on. Further, by the voltage in the second node N2 of the driving transistor DRT, a line capacitor Cline across the reference voltage line RVL may be charged, and the reference voltage line RVL may have a voltage corresponding to a voltage in the second node N2 of the driving transistor DRT by a sensing voltage Vsen charged in the line capacitor Cline.

The compensation circuit of the organic light emitting display device 100 may include an analog to digital converter ADC measuring a voltage in the reference voltage line RVL corresponding to a voltage in the second node N2 of the driving transistor DRT and then converting the measured voltage into a digital value, and switch circuits SAM and SPRE for sensing one or more characteristic values.

The switch circuits SAM and SPRE for controlling sensing driving may include a reference switch for sensing SPRE for controlling a connection between the reference voltage line RVL and a node for providing the reference voltage for sensing Npres to which a reference voltage for driving image Vref is applied, and a sampling switch SAM for controlling a connection between the reference voltage line RVL and the analog to digital converter ADC. Here, the reference switch for sensing SPRE is a switch for controlling the sensing driving, and a reference voltage Vref provided to the reference voltage line RVL by the reference switch for sensing SPRE corresponds to a reference voltage for sensing VpreS.

Further, the switch circuit for sensing characteristic values of the driving transistor DRT may include an reference switch for driving image RPRE. The reference switch for driving image RPRE controls a connection between the reference voltage line RVL and a node for providing the reference voltage for driving image Nprer to which a reference voltage Vref is applied. The reference switch for driving image RPRE is a switch used for controlling the image driving, and a reference voltage Vref provided to the reference voltage line RVL by the reference switch for driving image RPRE corresponds to a reference voltage for driving image VpreR.

The reference switch for driving image RPRE and the reference switch for sensing SPRE may be provided separately from each other, or integrated with each other and in turn, implemented in a single body. The reference voltage for driving image VpreR and the reference voltage for sensing VpreS may be an identical voltage value or different voltage values.

In the organic light emitting display device 100, together with the compensation circuit, a memory MEM storing sensing values output from the analog to digital converter ADC or storing one or more reference threshold voltages in advance, and a compensator COMP calculating a compensation value for compensating for a difference in one or more characteristic values by comparing a sensing value and a reference threshold voltage stored in the memory MEM may be included in a controller 140, such as a timing controller.

The timing controller 140 may obtain a data voltage DATA in the form of a digital signal to be provided to the data driving circuit 130 using the compensation value calculated by the compensator COMP, and then output the resulted data voltage DATA_comp to the data driving circuit 130. According to this, the data driving circuit 130 may convert the data voltage DATA_comp into a data voltage Vdata_comp in the form of an analog signal through a digital to analog converter DAC, and output the converted data voltage Vdata_comp to a corresponding data line DL through an output buffer BUF. As a result, a deviation in one or more characteristic values (a deviation of threshold voltage, a deviation of mobility, etc.) for a driving transistor DRT in a corresponding sub-pixel SP can be compensated.

Meanwhile, the data driving circuit 130 may include a data voltage output circuit 400 including a latch circuit, the digital to analog converter DAC, the output buffer BUF, and the like. In some instances, the data driving circuit 130 may further include an analog to digital converter ADC and several types of switches (SAM, SPRE, RPRE). In another embodiment, the analog to digital converter ADC and the several types of switches (SAM, SPRE, RPRE) may be located outside of the data driving circuit 130.

Further, the compensator COMP may be located outside of the timing controller 140 or included inside of the timing controller 140, and the memory MEM may be located outside of the timing controller 140 or implemented in the form of a register inside of the timing controller 140.

Figure 5:
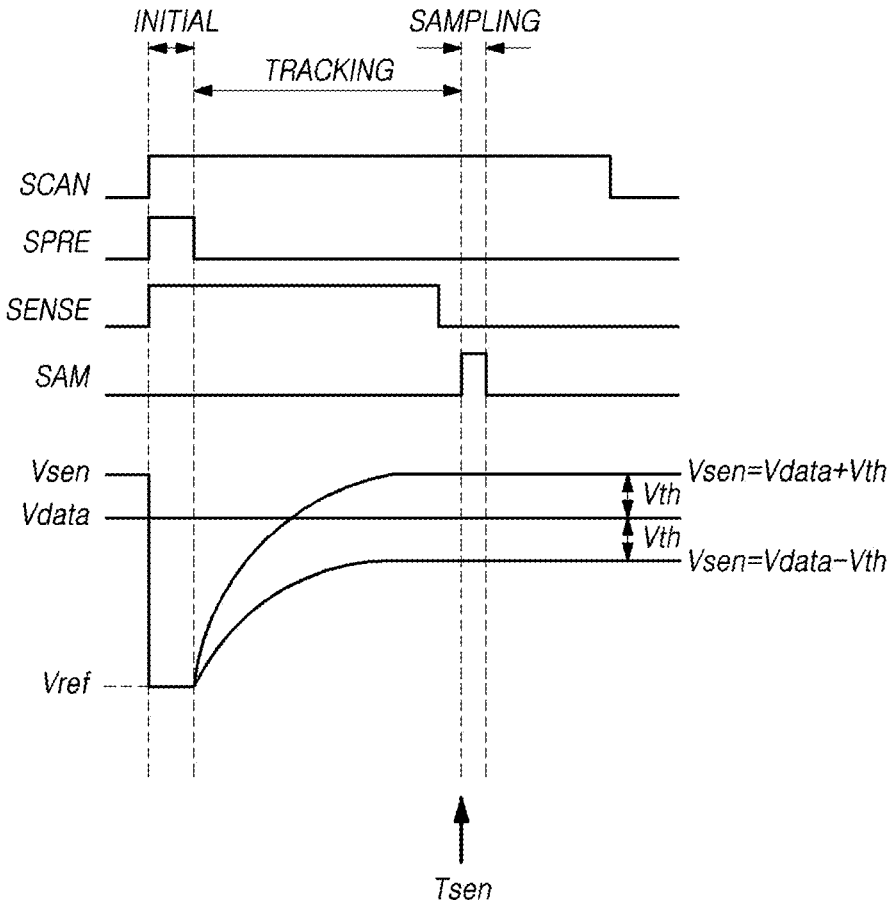
FIG. 5 represents a signal timing diagram for sensing a threshold voltage of characteristic values of a driving transistor in the organic light emitting display device according to embodiments of the present disclosure.

FIG. 5 represents a signal timing diagram for threshold voltage sensing among characteristic values of a driving transistor in the organic light emitting display device according to embodiments of the present disclosure.

Referring to FIG. 5, in the organic light emitting display device 100 according to embodiments of the present disclosure, the sensing of one or more characteristic values of a driving transistor DRT may be performed by a real-time sensing process by which sensing is performed in real time in a blank period. The sensing period may include an initialization step INITIAL, a tracking step TRACKING, and a sampling step SAMPLING.

Since a threshold voltage of the driving transistor DRT is normally sensed by individually turning on or turning off a switching transistor SWT and a sensing transistor SENT, sensing operations may be performed in a structure in which a scan signal SCAN and a sense signal SENSE are individually applied to the respective switching transistor SWT and sensing transistor SENT through two gate lines GL.

In the initialization step INITIAL, the switching transistor SWT is turned on by a scan signal SCAN with a turn-on level, and the first node N1 of the driving transistor DRT is initialized to a data voltage Vdata for sensing a threshold voltage. Further, the sensing transistor SENT is turned on by a sense signal SENSE with a turn-on level, and the reference switch for sensing SPRE is turned on. In this situation, the second node N2 of the driving transistor DRT is initialized to a reference voltage for sensing Vref, which may be VpreS. The data voltage Vdata for sensing a threshold voltage may be higher than the reference voltage for sensing Vref.

Tracking step TRACKING means a step of tracking a threshold voltage of the driving transistor DRT. In tracking step TRACKING, the scan signal SCAN with the turn-on level is remained, and the reference switch for sensing SPRE is transitioned to a turn-off level. Thereby, the second node N2 of the driving transistor DRT is floated; a voltage in the second node N2 of the driving transistor DRT rises. In particular, since the second node N2 of the driving transistor DRT has been initialized to the reference voltage for sensing Vref, the voltage in the second node N2 of the driving transistor DRT starts to rise from the reference voltage for sensing Vref. At this time, since the sensing transistor SENT has been turned on, the voltage rise in the second node N2 of the driving transistor DRT leads a voltage in the reference voltage line RVL to rise.

The voltage rise in the second node N2 of the driving transistor DRT continues until reaching a difference by a threshold voltage Vth from a data voltage Vdata. That is, when the voltage in the second node N2 of the driving transistor DRT corresponds to a voltage resulted from adding the threshold voltage to the data voltage (Vdata+Vth) or a voltage resulted from subtracting the threshold voltage from the data voltage (Vdata−Vth) according to a type of the driving transistor, the voltage in the second node N2 of the driving transistor DRT saturates. At the end of the tracking step TRACKING, the sensing transistor SENT may be turned off by a sense signal SENSE with a turn-off level.

In the sampling step SAMPLING, the sampling switch SAM is turned on at a sensing time Tsen at which a predetermined time has elapsed from a time at which the voltage in the second node N2 of the driving transistor DRT starts to rise. The sensing time Tsen may correspond to a predetermined time point after the end of the initialization step INITIAL. At this time, the analog to digital converter ADC may sense a voltage in the reference voltage line RVL connected by the sampling switch SAM, i.e. a sensing voltage Vsen formed in both terminals of the line capacitor Cline, and convert the sensed voltage into a sensing value in the form of a digital signal.

Here, the sensing time Tsen at which the sampling switch SAM is turned on in order to sense a change in the threshold voltage of the driving transistor DRT may be defined as a time point at which a change of voltage Vgs between the gate node and the source node of the driving transistor DRT approaches zero after the sensing voltage Vsen saturates sufficiently, for example, may be a time point at which 30 to 40 ms elapses after the tracking step TRACKING has been started.

The compensator COMP can derive a threshold voltage Vth of the driving transistor DRT in a corresponding sub-pixel SP based on a sensing value output from the analog to digital converter ADC, and compensate for a deviation of the driving transistor DRT using the resulted threshold voltage.

Thus, the sensing of a voltage in the reference voltage line RVL, that is, the voltage Vsen formed between both terminals of the line capacitor Cline, by the analog to digital converter ADC may have an equal meaning to the sensing of a voltage in the second node N2 of the driving transistor DRT.

When sensing the sensing voltage Vsen, the analog to digital converter ADC can obtain a threshold voltage Vth of the driving transistor DRT based on a pre-obtained corresponding data voltage Vdata.

Here, in order to sense accurately a threshold voltage Vth of the driving transistor DRT, since the sensing is needed to be performed when a voltage in the second node N2 of the driving transistor DRT saturates, that is, after a voltage in the reference voltage line RVL saturates, a long sensing time is therefore required.

In particular, these days, a size of a sub-pixel SP has been gradually reduced to realize high resolution, and a size of a driving transistor DRT has been also reduced. The reduction in the size of the driving transistor DRT according to the implementation of the high resolution leads to a decrease in the current driving capability of the driving transistor DRT, and in turn, a long time is needed to charge the line capacitor Cline of a reference voltage line RVL. As a result, a sensing time Tsen needed to sense a threshold voltage Vth of the driving transistor DRT is forced to be longer.

At this time, in a process of sensing the threshold voltage Vth of the driving transistor DRT, since it may take a long time to saturate a voltage in the second node N2 of the driving transistor DRT, an off-sensing process taking a longer time can be performed.

Figure 6:
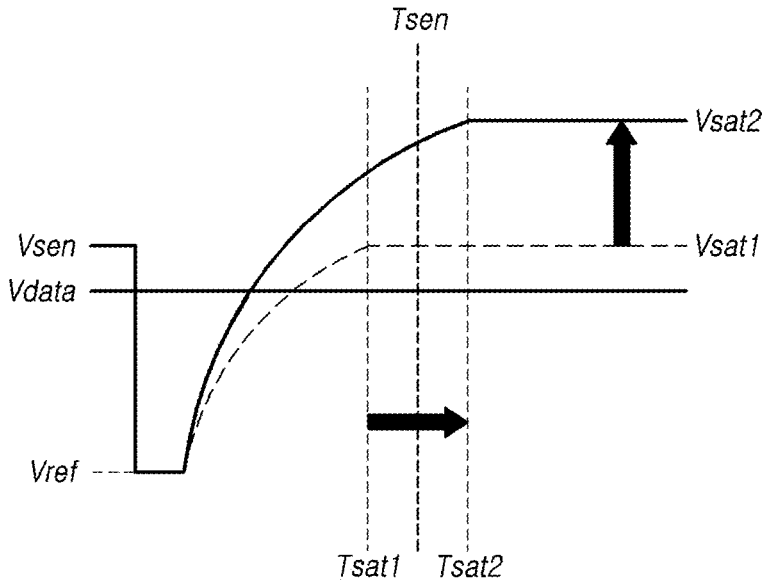
FIG. 6 illustrates a change in a sensing time according to a change in a threshold voltage distribution of a driving transistor in the organic light emitting display device according to embodiments of the present disclosure.

FIG. 6 illustrates a change in a sensing time according to a change in a threshold voltage distribution of a driving transistor in the organic light emitting display device according to embodiments of the present disclosure.

Referring to FIG. 6, in a situation where an initial pre-charge voltage charged in a line capacitor Cline connected to a reference voltage line RVL is fixed to a reference voltage Vref, a corresponding saturation voltage Vsat changes, for example from Vsat1 to Vsat2, as a threshold voltage Vth changes due to degradation of the driving transistor DRT.

FIG. 6 illustrates that the distribution of threshold voltages Vth of the driving transistor DRT generally moves in a positive direction as the driving transistor DRT is gradually degraded over driving time. Due to the change in such a threshold voltage distribution, an average value, a lower limit value, and an upper limit value of the threshold voltage Vth move in the right and upward direction.

Because of this, a voltage Vsat at the time of the saturation of the line capacitor Cline increases, and a time Tsat at which a voltage in the second node N2 of the driving transistor DRT saturates is delayed, for example from Tsat1 to Tsat2. Accordingly, a sensing time Tsen needed for accurately sensing a corresponding threshold voltage Vth is increased.

Meanwhile, even when a threshold voltage Vth of the driving transistor DRT is not changed, mobility of the driving transistor DRT may be changed, or a saturation time of a sensing voltage Vsen may be changed due to a change in other characteristics.

Figure 7:
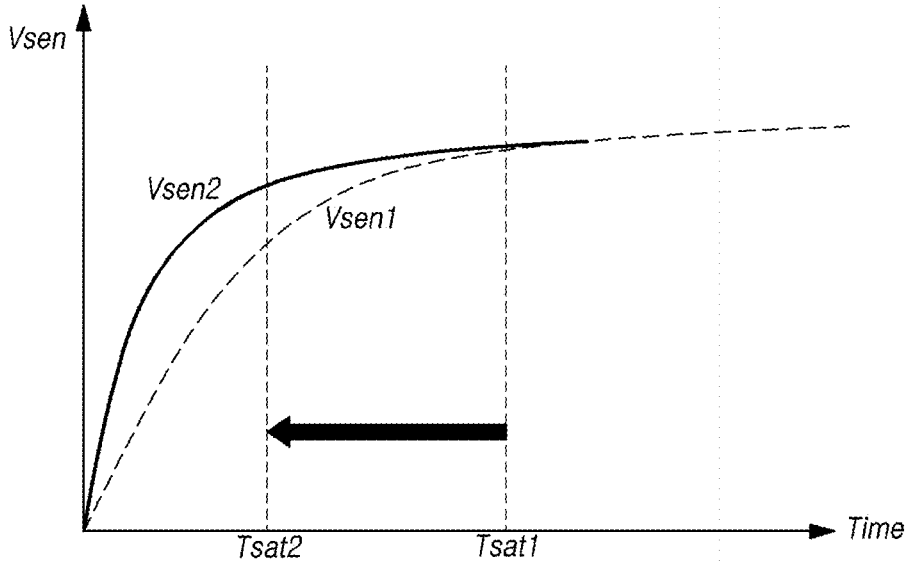
FIG. 7 illustrates a situation where a saturation time of a sensing voltage for a driving transistor in the organic light emitting display device is changed according to embodiments of the present disclosure.

FIG. 7 illustrates a situation where a saturation time of a sensing voltage for a driving transistor in the organic light emitting display device is changed according to embodiments of the present disclosure.

Referring to FIG. 7, in a situation where an initial pre-charge voltage charged in a line capacitor Cline connected to a reference voltage line RVL is fixed to a reference voltage Vref, a time Tsat at which the second node N2 of the driving transistor DRT saturates may increase or decrease according to a change in mobility of the driving transistor DRT or driving characteristics of the organic light emitting display device 100.

For example, as the organic light emitting display device 100 is used, in a situation where mobility of a driving transistor DRT is changed in a positive direction, or an image driving time for displaying image data on the organic light emitting display device 100 is short, a time Tsat at which a voltage in the second node N2 of the driving transistor DRT, that is, the sensing voltage Vsen resulted from charging in the line capacitor Cline, saturates may be reduced (from Tsat1 to Tsat2).

Like this, when the time at which the sensing voltage Vsen saturates is reduced, the sensing of a sensing voltage Vsen of the line capacitor Cline at an initially set sensing time Tsen1, that is, a sensing time Tsen1 set in consideration of an initial saturation time Tsat1 rather results in delaying the sensing and compensation process of the organic light emitting display device 100.

Accordingly, in this case, the sensing of a sensing voltage Vsen in the line capacitor Cline at a saturation time Tsat2 shorter than the initial saturation time Tsat1 may cause the sensing and compensation time of the organic light emitting display device 100 to be reduced, and enable the driving to be more efficient.

Thus, according to embodiments of the present disclosure, proposed herein are a display device 100 and a driving method for enabling a sensing time needed to sense one or more characteristic values of a driving transistor DRT to be reduced. Further, according to embodiments of the present disclosure, proposed herein are a display device 100 and a driving method for enabling optimal sensing and compensation to be implemented by changing a sensing time needed to sense one or more characteristic values of a driving transistor DRT according to an available time for sensing.

Figure 8:
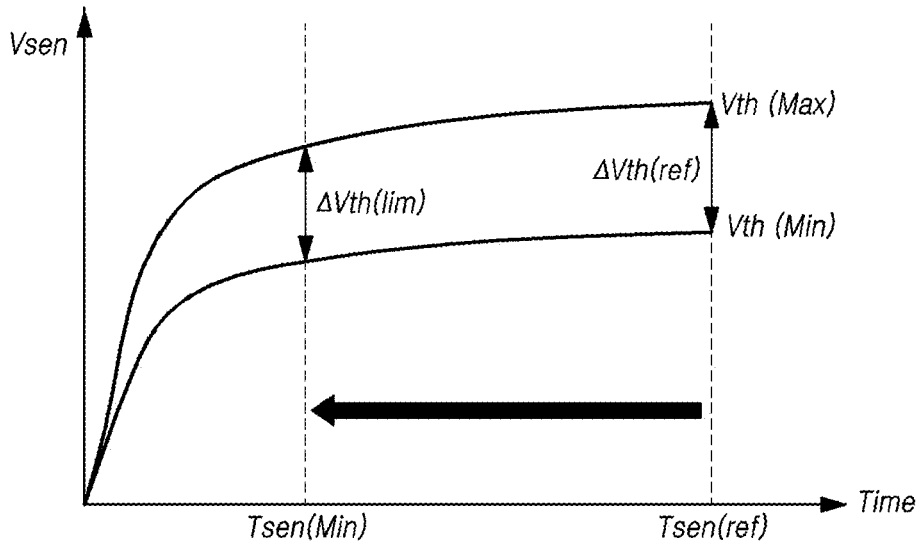
FIG. 8 illustrates a process of determining a minimum sensing time for a driving transistor in the organic light emitting display device according to embodiments of the present disclosure.

FIG. 8 illustrates a process of determining a minimum sensing time for a driving transistor in the organic light emitting display device according to embodiments of the present disclosure.

Referring to FIG. 8, in the organic light emitting display device 100 according to embodiments of the present disclosure, a reference sensing time Tsen(ref) may be defined as a time point at which after a voltage in the second node N2 of a driving transistor DRT, that is, a sensing voltage Vsen in the reference voltage line RVL, saturates sufficiently, a change of a voltage Vgs between gate and source nodes of the driving transistor DRT approaches zero. Such a reference sensing time Tsen(ref) may be stored in the memory MEM, and a sensing voltage Vsen can be sensed as the timing controller 140 turns on the sampling switch SAM in the reference sensing time Tsen(ref) with reference to the memory MEM.

The organic light emitting display device 100 according to embodiments of the present disclosure calculates a difference between a maximum threshold voltage Vth(Max) and a minimum threshold voltage Vth(Min) among a plurality of sub-pixels SP disposed in a display panel 110 over one or more sensing times Tsen in order to determine a minimum sensing time Tsen(Min) for sensing a sensing voltage Vsen in a reference voltage line RVL.

That is, after calculating a reference threshold voltage difference ΔVth(ref) corresponding to a difference between a maximum threshold voltage Vth(Max) and a minimum threshold voltage Vth(Min) at a specific time less than or equal to a reference sensing time Tsen(ref), a minimum sensing time Tsen(Min) among times corresponding to a critical threshold voltage difference ΔVth(lim) that can be regarded as a level equal to or similar to the reference threshold voltage difference ΔVth(ref) may be determined as a sensing time of the organic light emitting display device 100.

At this time, the maximum threshold voltage Vth(Max) may be derived from a driving transistor DRT with a greatest threshold voltage Vth among all sub-pixels SP or one or more sub-pixels SP disposed in the display panel 110, and the minimum threshold voltage Vth(Min) may be derived from a driving transistor DRT with a smallest threshold voltage Vth among all sub-pixels SP or one or more sub-pixels SP disposed in the display panel 110.

The critical threshold voltage difference ΔVth(lim) served as a reference for selecting a sensing time Tsen may be set to have a value equal to the reference threshold voltage difference ΔVth(ref), or set variously according to types and characteristics of organic light emitting display devices 100 while being set to have a value similar to the reference threshold voltage difference ΔVth(ref). The critical threshold voltage difference ΔVth(lim) may be set to have a value smaller than the reference voltage difference ΔVth(ref).

Figure 9:
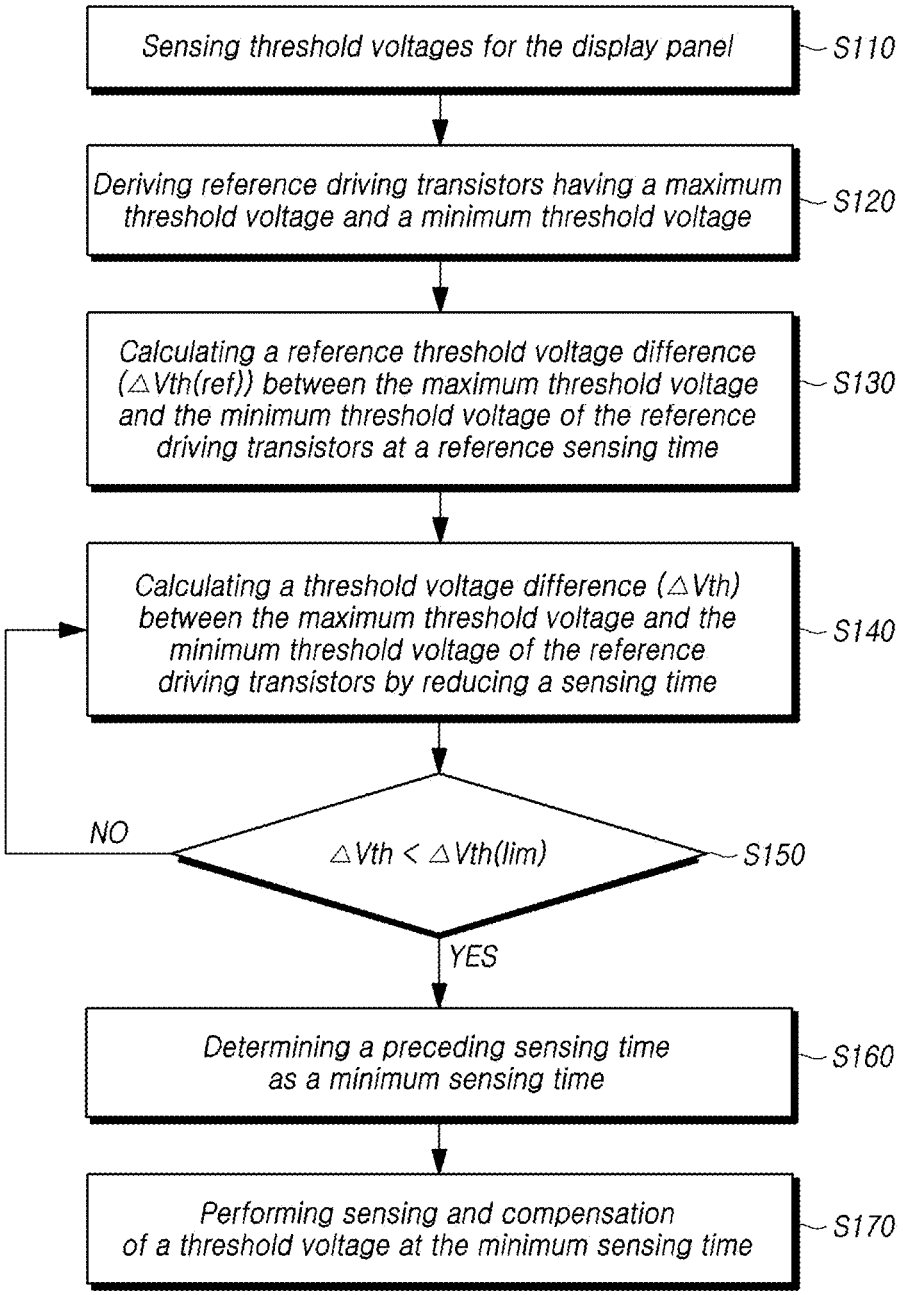
FIG. 9 is a flow chart illustrating a process of determining a minimum sensing time for a driving transistor in the organic light emitting display device according to embodiments of the present disclosure.

FIG. 9 is a flow chart illustrating a process of determining a minimum sensing time for a driving transistor in a method of driving the organic light emitting display device according to embodiments of the present disclosure.

Referring to FIG. 9, in the organic light emitting display device 100 according to embodiments of the present disclosure, a process of determining a minimum sensing time Tsen(Min) for at least one driving transistor DRT may include a step S110 of sensing threshold voltages for the display panel 110, a step S120 of deriving reference driving transistors DRT with a maximum threshold voltage Vth (Max) and a minimum threshold voltage Vth(Min), a step S130 of calculating a reference threshold voltage difference ΔVth(ref) between the maximum threshold voltage Vth (Max) and the minimum threshold voltage Vth(Min) of the reference driving transistors DRT at a reference sensing time Tsen(ref), a step S140 of calculating a threshold voltage difference ΔVth between the maximum threshold voltage Vth(Max) and the minimum threshold voltage Vth(Min) of the reference driving transistors DRT by reducing a sensing time Tsen, a step S150 of comparing the threshold voltage difference ΔVth with a critical threshold voltage difference ΔVth(lim), a step S160 of determining a previous sensing time Tsen as a minimum sensing time Tsen(Min) when the threshold voltage difference ΔVth is smaller than the critical threshold voltage difference ΔVth(lim), and a step S170 of performing sensing and compensation of the at least one driving transistor DRT at the minimum sensing time Tsen (Min).

The step S110 of sensing the threshold voltages for the display panel 110 is a step of sensing the threshold voltage Vth of the driving transistors among all sub-pixels or one or more sub-pixels of the display panel 110. The sensed sub-pixels may include the sub-pixel which includes the driving transistor for which the minimum sensing time Tsen(Min) should be determined. The step S120 may be a step of deriving a driving transistor DRT with a greatest threshold voltage Vth and a driving transistor DRT with a smallest threshold voltage Vth among all sub-pixels or one or more sub-pixels disposed in the display panel 110. A reference sensing time Tsen(ref) stored in the memory MEM or a time point different from the reference sensing time Tsen(ref) may serve as a time point at which one or more characteristic values are sensed.

The step S120 of deriving the reference driving transistors DRT with the maximum threshold voltage Vth(Max) and the minimum threshold voltage Vth(Min) is a step of deriving the greatest threshold voltage Vth and the smallest threshold voltage Vth among driving transistors DRT for which sensing for characteristic values is performed. Here, the maximum threshold voltage Vth(Max) and the minimum threshold voltage Vth(Min) may be set such that an upper limit value of a certain range and a lower limit value of a certain range are set based on 0.7V of normal threshold voltage corresponding to a typical threshold voltage Vth and then a greatest threshold voltage Vth and a smallest threshold voltage Vth may be derived between the upper limit value and the lower limit value.

The step S130 of calculating the reference threshold voltage difference ΔVth(ref) between the maximum threshold voltage Vth(Max) and the minimum threshold voltage Vth(Min) of the reference driving transistors DRT at the reference sensing time Tsen(ref) is a step of calculating the reference threshold voltage difference ΔVth(ref) corresponding to a difference between the maximum threshold voltage Vth(Max) and the minimum threshold voltage Vth (Min) for the reference driving transistors DRT calculated at the reference sensing time Tsen(ref).

The step S140 of calculating the threshold voltage difference ΔVth between the maximum threshold voltage Vth (Max) and the minimum threshold voltage Vth(Min) of the reference driving transistors DRT by reducing a sensing time Tsen is a step of sequentially calculating a threshold voltage difference ΔVth at each sensing time Tsen by changing a sensing time Tsen at which characteristic values of the reference driving transistors DRT are sensed based on a time smaller than the reference sensing time Tsen(ref).

The step S150 of comparing the threshold voltage difference ΔVth with the critical threshold voltage difference ΔVth(lim) is a step of comparing whether a threshold voltage difference ΔVth of the reference driving transistors DRT is smaller than the critical threshold voltage difference ΔVth(lim).

Here, the critical threshold voltage difference ΔVth(lim) may be a minimum threshold voltage difference ΔVth regarded as a level equal to, or similar to, the reference threshold voltage difference ΔVth(ref). That is, this may be performed by checking whether a threshold voltage difference ΔVth for the reference driving transistors DRT at a minimum sensing time Tsen(Min) is within a range of a critical threshold voltage difference ΔVth(lim) regarded as a saturation state similar to the reference threshold voltage difference ΔVth(ref).

As a result of the checking, when a threshold voltage difference ΔVth at a specific sensing time Tsen is smaller than the critical threshold voltage difference ΔVth(lim), a previous sensing time Tsen may be determined as a minimum sensing time Tsen(Min), at step S160. Thereby, the smallest sensing time Tsen within the range of the critical threshold voltage difference ΔVth(lim) may be determined as the minimum sensing time Tsen(Min).

The step S170 of performing the sensing and compensation of the at least one driving transistor DRT at the minimum sensing time Tsen(Min) is a step of sensing characteristic values of driving transistors DRT and then compensating for the characteristic values at the minimum sensing time Tsen(Min) after determining the minimum sensing time Tsen(Min).

Accordingly, by determining a minimum sensing time Tsen(Min) with a smallest sensing time Tsen while representing characteristics similar to characteristics that the driving transistors DRT can represent in a saturation state, and sensing characteristic values of the driving transistors DRT at the minimum sensing time Tsen(Min), it is possible to provide an effect of reducing a sensing time of the organic light emitting display device 100.

Further, in the organic light emitting display device 100 according to embodiments of the present disclosure, while sensing characteristic values of a driving transistor DRT at a minimum sensing time Tsen(Min), the sensing and compensation of characteristic values of the driving transistor DRT can be performed at a maximum sensing time after having determined the maximum sensing time providing a highest accurate compensation by changing a sensing time Tsen. A greater or longer sensing time Tsen may increase the accuracy of the sensing of the characteristics of the driving transistor DRT.

Figure 10:
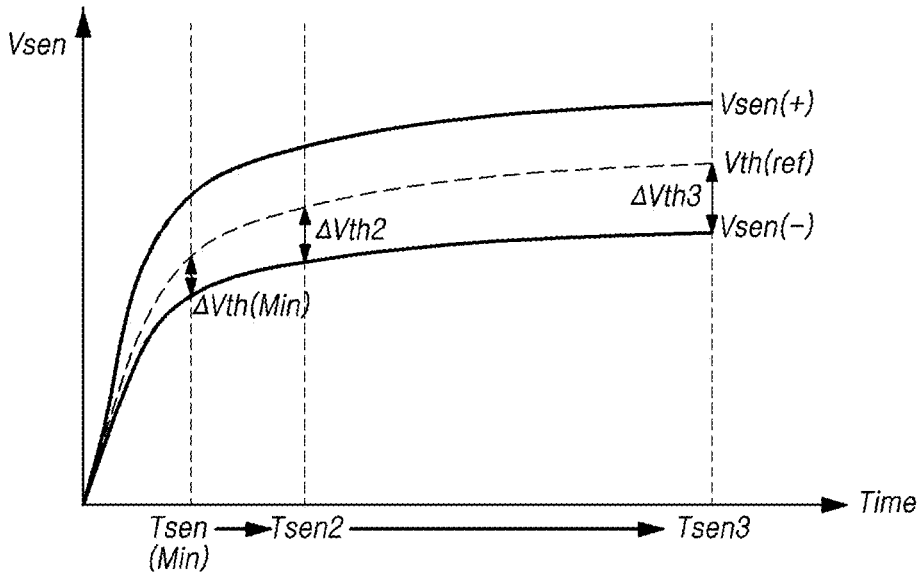
FIG. 10 illustrates a process of determining a maximum sensing time by changing a sensing time for a driving transistor in the organic light emitting display device according to embodiments of the present disclosure.

FIG. 10 illustrates a process of determining a maximum sensing time by changing a sensing time for a driving transistor in the organic light emitting display device according to embodiments of the present disclosure.

Referring to FIG. 10, the organic light emitting display device 100 according to embodiments of the present disclosure can perform sensing and compensation of characteristic values of one or more driving transistors DRT disposed in the display panel 100 at a minimum sensing time Tsen(Min).

As described above, the minimum sensing time Tsen (Min) may be determined as a time with a smallest sensing time Tsen while representing characteristics equal to, or similar to, characteristics that the driving transistor DRT represents in a saturation state.

In the range of performing a corresponding sensing process in the organic light emitting display device 100, since the driving transistor DRT may be regarded as entering in a stable saturation state when performing sensing and compensation of characteristic values of a driving transistor DRT at a maximum sensing time Tsen(Max), it is therefore possible to improve the accuracy of the compensation.

One or more driving transistors DRT for which the sensing characteristic values is performed at a minimum sensing time Tsen(Min) may be any driving transistor DRT selected, or one or more driving transistors DRT sequentially selected, from driving transistors DRT disposed the display panel 110.

Further, the compensation of at least one characteristic value of one or more driving transistors DRT may be performed by converting data voltage Vdata according to a reference threshold voltage Vth(ref) stored in the memory MEM.

The reference threshold voltage Vth(ref) may be set as one or more of optimal threshold voltages of driving transistors DRT stored in the memory MEM at the time of manufacturing the organic light emitting display device 100 herein. In another example, taking account of changes in threshold voltages Vth of the driving transistors DRT as the organic light emitting display device 100 is aged as a result of being used over time, the reference threshold voltage Vth(ref) may be set as an average value of threshold voltages Vth of the driving transistors DRT disposed on the display panel 110 at a specific time. In further another example, the reference threshold voltage Vth(ref) may be set as an average value of a maximum threshold voltage Vth(Max) and a minimum threshold voltage Vth(Min) of the driving transistors DRT disposed on the display panel 110.

When a voltage Vsen(Min) sensed at the minimum sensing time Tsen(Min) is larger (Vsen(+)) than the reference threshold voltage Vth(ref), a compensation of the data voltage Vdata may be performed that the sensing voltage Vsen(Min) corresponds to a difference between the sensing voltage Vsen(Min) and the reference threshold voltage Vth (ref). When the voltage Vsen(Min) sensed at the minimum sensing time Tsen(Min) is smaller (Vsen(−)) than the reference threshold voltage Vth(ref), a compensation of the data voltage Vdata may be performed that the sensing voltage Vsen(Min) corresponds to a difference between the sensing voltage Vsen(Min) and the reference threshold voltage Vth (ref).

When a compensation for a threshold voltage Vth is performed at a minimum sensing time Tsen(Min), sensing and compensation of one or more characteristic values for any driving transistor DRT may be performed by sequentially increasing a sensing time Tsen from the minimum sensing time Tsen(Min).

For example, when the minimum sensing time Tsen(Min) is set to 10 ms, the sensing of a threshold voltage Vth of at least one driving transistor DRT may be performed in 10 ms after a tracking step TRACKING has been started, and a corresponding compensation may be performed according to a reference threshold voltage Vth(ref) stored in the memory MEM. When the sensing and compensation of one or more characteristic values at the minimum sensing time Tsen(Min) are normally performed, the sensing and compensation of the characteristic values may be performed by increasing a corresponding sensing time Tsen2 to 30 ms. By repeating these processes, a maximum sensing time Tsen (Max) for allowing sensing and compensation of characteristic values may be determined.

Here, as a sensing time Tsen increases, accuracy of sensing and compensation of characteristic values of the organic light emitting display device 100 may increase.

Like this, when sequentially performing the sensing of characteristic values of driving transistors DRT by increasing a sensing time Tsen (from Tsen(Min) to Tsen2 to Tsen3), even when power of the organic light emitting display device 100 at a certain time is turned off or a corresponding sensing process is terminated, since the compensation of at least one characteristic value that has performed at a previous time has been already applied to the organic light emitting display device 100, it is possible to increase the probability of successful compensation.

Through these processes, the organic light emitting display device 100 can perform the sensing and compensation of characteristic values of driving transistors DRT at a maximum sensing time Tsen(Max) at which a compensation with the highest accuracy is available by changing a sensing time Tsen. The maximum sensing time Tsen(Max) may be a time at which a last sensing is performed before the corresponding sensing process is terminated.

Figure 11:
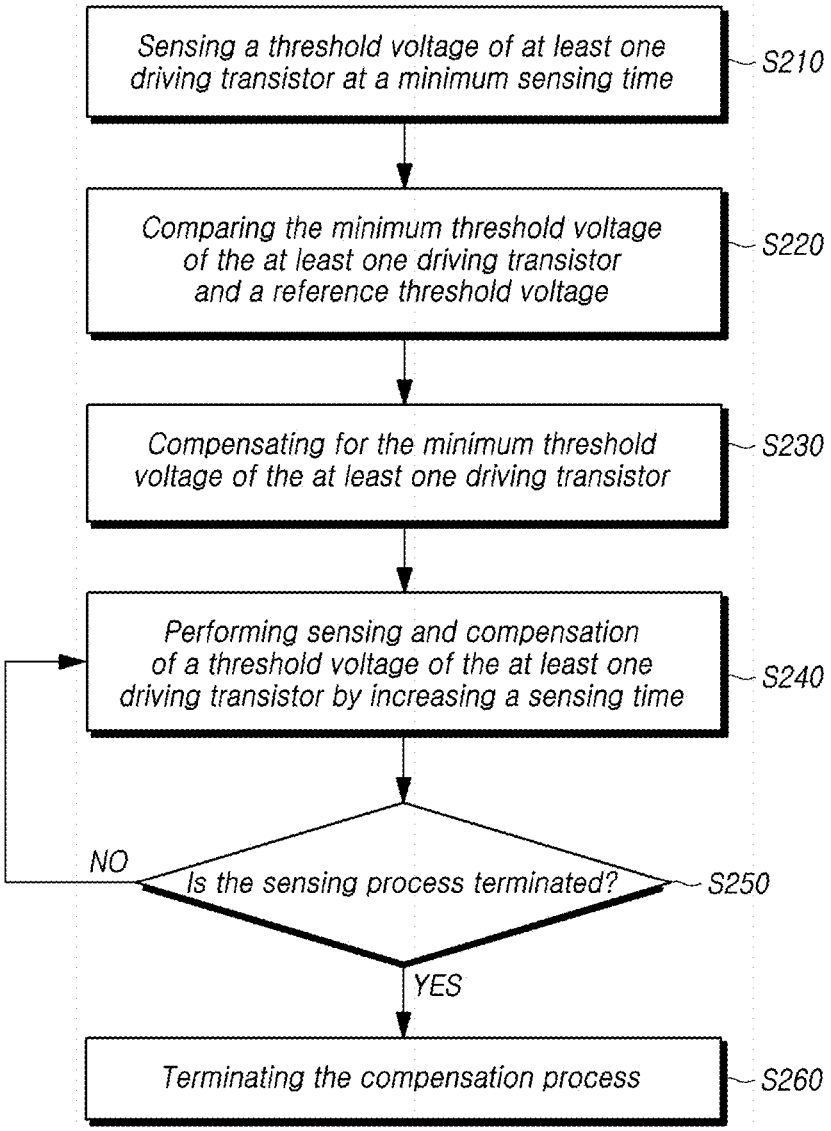
FIG. 11 is a flow chart illustrating a process of performing characteristic value sensing and compensation by changing a sensing time for a driving transistor in the organic light emitting display device according to embodiments of the present disclosure.

FIG. 11 is a flow chart illustrating a process of performing characteristic value sensing and compensation by changing a sensing time for at least one driving transistor in the organic light emitting display device according to embodiments of the present disclosure.

Referring to FIG. 11, in the organic light emitting display device 100 according to embodiments of the present disclosure, a process of performing characteristic value sensing and compensation by changing a sensing time Tsen for at least one driving transistor DRT may include a step S210 of sensing a threshold voltage Vth of the at least one driving transistor DRT at a minimum sensing time Tsen(Min), a step S220 of comparing the threshold voltage Vth of the at least one driving transistor DRT with a reference threshold voltage Vth(ref), a step S230 of compensating for the threshold voltage Vth of the at least one driving transistor DRT, a step S240 of performing the sensing and compensation of a threshold voltage Vth of the at least one driving transistor DRT by increasing a sensing time Tsen, a step S250 of determining whether the sensing process is terminated, and a step S260 of terminating the compensation process when the sensing process is terminated.

The step S210 of sensing the threshold voltage Vth of the at least one driving transistor DRT at the minimum sensing time Tsen(Min) is a step of performing the sensing of a threshold voltage Vth for any driving transistor DRT at a time at which a preset minimum sensing time Tsen(Min) elapses after the sensing process is initiated for at least one characteristic values of the driving transistor, for example, a threshold voltage.

The minimum sensing time Tsen(Min) may be a time arbitrarily set at the time of manufacturing the organic light emitting display device 100, or a time representing characteristics equal to, or similar to, characteristics that the driving transistor DRT can represent in a saturation state as described above. The minimum sensing time Tsen(Min) may be stored in the memory MEM and may serve as a time point at which one or more characteristic values, that is the threshold voltage Vth, of the driving transistor are sensed according to the above-described sensing.

The step S220 of comparing the threshold voltage Vth of the at least one driving transistor DRT with the reference threshold voltage Vth(ref) is a step of comparing the sensing voltage Vsen(Min) for the threshold voltage Vth of the at least one driving transistor DRT sensed at the minimum sensing time Tsen(Min) with a reference threshold voltage Vth(ref) stored in the memory MEM.

The step S230 of compensating for the minimum threshold voltage Vth(Min) of the at least one driving transistor DRT is a step of converting the data voltage Vdata of the at least one driving transistor DRT sensed at the minimum sensing time Tsen(Min) to correspond to the reference threshold voltage Vth(ref) stored in the memory MEM.

When a voltage Vsen(Min) sensed at the minimum sensing time Tsen(Min) is larger (Vsen(+)) than the reference threshold voltage Vth(ref), a compensation of the data voltage Vdata may be performed that the sensing voltage Vsen(Min) corresponds to a difference between the sensing voltage Vsen(Min) and the reference threshold voltage Vth (ref). When the voltage Vsen(Min) sensed at the minimum sensing time Tsen(Min) is smaller (Vsen(−)) than the reference threshold voltage Vth(ref), a compensation of the data voltage Vdata may be performed that the sensing voltage Vsen(Min) corresponds to a difference between the sensing voltage Vsen(Min) and the reference threshold voltage Vth (ref).

The step S240 of performing the sensing and compensation of the threshold voltage Vth of the at least one driving transistor DRT by increasing a sensing time Tsen is a step of performing the sensing and compensation of a threshold voltage Vth of a driving transistor DRT corresponding to at each sensing time Tsen by sequentially increasing a sensing time Tsen from the minimum sensing time Tsen(Min).

For example, the minimum sensing time Tsen(Min) is set to 10 ms, the sensing of a threshold voltage Vth of a driving transistors DRT may be performed in 10 ms after a tracking step TRACKING has been started, and a corresponding compensation may be performed according to a reference threshold voltage Vth(ref) stored in the memory MEM. Thereafter, the sensing and compensation of the threshold voltage Vth of the driving transistor DRT is performed again by increasing the sensing time Tsen to Tsen2, for example 30 ms. This process may be repeated until the sensing process is terminated.

Accordingly, as long as the sensing process continues, since the sensing time Tsen for the threshold voltage Vth of the driving transistor DRT increases, and the driving transistor DRT enters in a stable saturation state, it is therefore possible to improve the accuracy of the sensing and compensation of the threshold voltage Vth.

The step S250 of determining whether the sensing process is terminated is a step of determining whether the organic light emitting display device 100 terminates the corresponding sensing process, and power supply is turned off or another process other than the sensing process is performed.

If the sensing process is remained, the process of sensing the threshold voltage Vth and compensating for the threshold voltage Vth may be repeated by sequentially increasing a sensing time Tsen.

As power supply is terminated or another process is performed, when the sensing process is terminated, the process of sensing and compensating for the threshold voltage Vth may be terminated by sequentially increasing a sensing time Tsen.

Accordingly, the organic light emitting display device 100 herein can perform the sensing and compensation of characteristic values of driving transistors DRT at a maximum sensing time Tsen(Max) at which a compensation with the highest accuracy is available by sequentially increasing a sensing time Tsen.

Herein, although discussion on the embodiments of the present disclosure has been performed based on the organic light emitting display device, display devices to which the embodiments of the present disclosure are applied may include any or all types of display devices, such as an electroluminescent device (EL), a liquid crystal display device (LCD), a vacuum fluorescent display device (VFD), a field emission display device (FED), and a plasma display panel (PDP), as well as the organic light emitting display device.

It will be apparent to those skilled in the art that various modifications and variations can be made in the display device and the method for driving the same of the present disclosure without departing from the technical idea or scope of the disclosure. Thus, it is intended that the present disclosure cover the modifications and variations of this disclosure provided they come within the scope of the appended claims and their equivalents.

REFERENCE SIGNS

100: organic light emitting display device
110: display panel
120: gate driving circuit
130: data driving circuit
140: timing controller
210: power management integrated circuit
220: main power management circuit
230: set board

What is claimed is:

1. A display device, comprising:

a display panel on which a plurality of gate lines, a plurality of data lines, and a plurality of subpixels are arranged;

a gate driving circuit configured to drive the plurality of gate lines;

a data driving circuit configured to drive the plurality of data lines;

a timing controller configured to:

control the gate driving circuit and the data driving circuit; and cause threshold voltages of driving transistors of the plurality of sub-pixels to be sensed at a minimum sensing time representing a critical threshold voltage difference corresponding to a reference threshold voltage difference; and a compensation circuit configured to:

calculate a compensation value for an image data voltage; and apply a changed image data voltage to a corresponding sub-pixel according to the calculated compensation value, using a sensing value for a threshold voltage of at least one of the plurality of driving transistors, wherein the reference threshold voltage difference corresponds to a difference between a maximum threshold voltage and a minimum threshold voltage of the driving transistors, wherein the critical threshold voltage difference has a value identical or similar to the reference threshold voltage difference, wherein the minimum sensing time is a first time among sensing times at which the critical threshold voltage difference is measured, and wherein, when the compensation at the minimum sensing time is performed by the compensation circuit, the timing controller is further configured to perform additional sensing and compensation of the threshold voltage of the at least one driving transistor by sequentially increasing a sensing time from the minimum sensing time.

2. The display device according to claim 1, wherein at least one of the plurality of sub-pixels comprises:

a light emitting element;

at least one of the driving transistors configured to drive the light emitting element;

a switching transistor electrically connected between a gate node of the at least one driving transistor and at least one of the plurality of data lines;

a sensing transistor electrically connected between a source node or a drain node of the at least one driving transistor and a reference voltage line; and a storage capacitor electrically connected between the gate node and the source or drain node of the at least one driving transistor.

3. The display device according to claim 2, wherein sensing of a threshold voltage for the at least one driving transistor comprises:

an initialization operation in which, in a state where the switching transistor is turned on, a data voltage for sensing is provided through the at least one of the plurality of data lines and a reference voltage for sensing is provided through the reference voltage line;

a tracking operation in which a voltage in the reference voltage line rises by blocking the reference voltage for sensing; and a sampling operation in which the threshold voltage for the at least one driving transistor is sensed through the reference voltage line.

4. A display device, comprising:

a display panel on which a plurality of gate lines, a plurality of data lines, and a plurality of subpixels are arranged;

a gate driving circuit configured to drive the plurality of gate lines;

a data driving circuit configured to drive the plurality of data lines; and a timing controller configured to:

control the gate driving circuit and the data driving circuit; and cause threshold voltages of driving transistors of the plurality of sub-pixels to be sensed at a minimum sensing time representing a critical threshold voltage difference corresponding to a reference threshold voltage difference; and a compensation circuit configured to calculate a compensation value for an image data voltage, and apply a changed image data voltage to a corresponding sub-pixel according to the calculated compensation value, using a sensing value for a threshold voltage of at least one of the plurality of driving transistors, wherein the reference threshold voltage difference corresponds to a difference between a maximum threshold voltage and a minimum threshold voltage of the driving transistors, wherein the critical threshold voltage difference has a value identical or similar to the reference threshold voltage difference, wherein the minimum sensing time is a first time among sensing times at which the critical threshold voltage difference is measured, and wherein the compensation circuit comprises:

an analog to digital converter configured to:

measure a voltage in a reference voltage line electrically connected to the at least one driving transistors; and convert the measured voltage to a digital value;

a switch circuit electrically connected between the at least one driving transistor and the analog to digital converter, the switch circuit being configured to control operations for sensing the threshold voltage of the at least one driving transistor;

a memory configured to:

store a sensing value output from the analog to digital converter; or store a reference threshold voltage in advance;

a compensator configured to:

compare between the sensing value and the reference threshold voltage stored in the memory; and determine a compensation value for compensating for a threshold voltage difference of the at least one driving transistor;

a digital to analog converter configured to change an image data voltage changed by the compensation value calculated from the compensator to an analog voltage; and a buffer configured to output the image data voltage in the form of analog output from the digital to analog converter to an indicated data line of the plurality of data lines.

5. A method of driving a display device including a display panel, on which a plurality of gate lines, a plurality of data lines, and a plurality of reference voltage lines are arranged, which includes a plurality of sub-pixels arranged in areas in which the plurality of data lines intersect the plurality of gate lines and causing organic light emitting elements to emit light through driving transistors, the method comprising:

sensing threshold voltages for the display panel;

deriving reference driving transistors having a maximum threshold voltage and a minimum threshold voltage;

calculating a reference threshold voltage difference between the maximum threshold voltage and the minimum threshold voltage at a reference sensing time;

calculating a threshold voltage difference between the maximum threshold voltage and the minimum threshold voltage of the reference driving transistors in a sensing time smaller than the reference sensing time;

comparing between the threshold voltage difference and a critical threshold voltage difference;

determining a second sensing time immediately preceding the reference sensing time as a minimum sensing time when the threshold voltage difference is smaller than the critical threshold voltage difference;

performing sensing and compensation of a threshold voltage for at least one driving transistor at the minimum sensing time; and after the compensation at the minimum sensing time is performed, performing additional sensing and compensation of the threshold voltage of the at least one driving transistor by sequentially increasing a sensing time from the minimum sensing time, wherein the reference sensing time corresponds to a time point at which, after a sensing voltage in a reference voltage line of the driving transistors is saturated, a change of a voltage between gate and source nodes of the driving transistors approaches zero, wherein the reference threshold voltage difference corresponds to a difference between a maximum threshold voltage and a minimum threshold voltage of the driving transistors, wherein the critical threshold voltage difference has a value identical or similar to the reference threshold voltage difference, and wherein the minimum sensing time is a first time among sensing times at which the critical threshold voltage difference is measured.

6. The method according to claim 5, wherein the sensing of the threshold voltage for the at least one driving transistor comprises:

an initialization operation in which, in a state where a switching transistor electrically connected between a gate node of the at least one driving transistor and at least one of the plurality of data lines is turned on, a data voltage for sensing is provided through the at least one data line and a reference voltage for sensing is provided through at least one of the plurality of reference voltage lines;

a tracking operation in which a voltage in the at least one reference voltage line rises by blocking the reference voltage for sensing; and a sampling operation in which the threshold voltage of the at least one driving transistor is sensed through the at least one reference voltage line.

7. The method according to claim 5, wherein the compensation of the threshold voltage is performed such that a compensation value for an image data voltage is calculated, and a changed image data voltage is applied to a corresponding sub-pixel according to the calculated compensation value, using a sensing value for the threshold voltage of the at least one driving transistor.

* * * * *